US006936391B2

(12) United States Patent
Kitani et al.

(10) Patent No.: US 6,936,391 B2
(45) Date of Patent: Aug. 30, 2005

(54) ELECTROSTATIC IMAGE DEVELOPING TONER AND IMAGE FORMING METHOD USING THE SAME

(75) Inventors: Tomoe Kitani, Hino (JP); Hiroshi Yamazaki, Hachioji (JP); Ken Ohmura, Hachioji (JP)

(73) Assignee: Konica Corporation, Tokyo (JP)

( * ) Notice: Subject to any disclaimer, the term of this patent is extended or adjusted under 35 U.S.C. 154(b) by 199 days.

(21) Appl. No.: 10/441,365

(22) Filed: May 20, 2003

(65) Prior Publication Data

US 2003/0228536 A1 Dec. 11, 2003

(30) Foreign Application Priority Data

May 28, 2002 (JP) ..... 2002-153902

(51) Int. Cl.[7] ..... G03G 9/08
(52) U.S. Cl. ..... 430/108.3; 430/137.14
(58) Field of Search ..... 430/108.3, 137.14

(56) References Cited

U.S. PATENT DOCUMENTS 6,316,155 B1 * 11/2001 Kudo et al. ..... 430/108.3
2003/0022085 A1 * 1/2003 Hayashi et al. ..... 430/108.3

FOREIGN PATENT DOCUMENTS

JP 05-265252 10/1993
JP 06-329947 11/1994
JP 09-015904 1/1997
JP 2001125306 A * 5/2001 ..... G03G/9/08

* cited by examiner

*Primary Examiner*—Christopher RoDee
(74) *Attorney, Agent, or Firm*—Squire, Sanders & Dempsey

(57) ABSTRACT

An electrostatic image developing toner is disclosed. The toner particle conrains a silanol compound represented by formula of $R_mSi(OH)_n$ in an amount of 1 to 20 ppm which is measured based on a head space method: wherein R represents a hydrocarbon group containing an alkyl group, a vinyl group, a glycidyloxy group, or a methacrylic acid, m and n each represents an integer of 1 to 3, and when m is 2 or 3, R may be the same of different.

5 Claims, 1 Drawing Sheet

ELECTROSTATIC IMAGE DEVELOPING TONER AND IMAGE FORMING METHOD USING THE SAME

FIELD OF THE INVENTION

Figure 1:
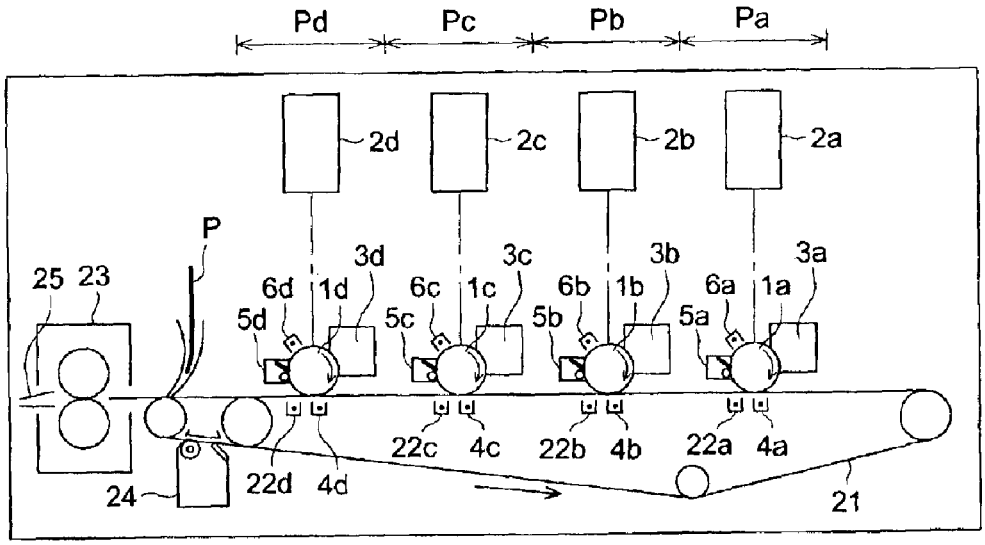

The present invention relates to an electrostatic image developing toner and an image forming method using the same.

BACKGROUND OF THE INVENTION

In digital copiers and laser printers, in order to obtain high quality images more approaching conventional photography, preferred are high gloss images which are produced employing toner comprised of particles having a smaller diameter. In order to decrease the diameter of toner particles, production of toner particles according to a polymerization method has received attention.

In copiers and the like, which utilize the electrophotographic process described above, it is required that a non-fixed toner image formed on a recording sheet is fixed to result in a permanent image. Known as such fixing methods are a solvent fixing method, a pressure fixing method, and a thermal fixing method.

Employed as thermal fixing methods are a thermal contact type heating roller system which exhibits high heat efficiency as well as high safety, and a film heating system which saves energy.

Thermal fixing apparatuses, which utilize the thermal contact fixing method, are comprised of a heating roller (being a fixing roller) and a pressure roller which is arranged to come into pressure contact with the fixing roller. The heating roller is comprised of a cored cylinder which comprises a heat lamp in its interior and a heat-resistant releasing layer is formed on its outer circumferential surface. The pressure roller is also compromised of a cored metal cylinder and a heat-resistant elastic material layer is formed on its outer circumferential surface. In conventional thermal fixing systems, supports such as plain paper sheets having a pre-fixed toner image are allowed to pass between both rollers to which a definite pressure is applied, whereby fixing is carried out. A heating roller type fixing apparatus which utilizes this system exhibits higher thermal efficiency compared to those utilizing other fixing systems such as a hot air fixing system or an oven fixing system, whereby, at present, the fixing apparatus is most widely employed due to lower power consumption, higher production rate, and reduced fire hazard due to paper jamming.

However, in the contact heating roller system fixing apparatus, which employs a heating roller (being a rotating member for fixing), when transfer materials and toners are heated by a heating roller having a halogen heater in its interior, the fixing and heating roller, which has a high heat capacity, is heated. As a result, problems occur in which the life of the heating rubber roller is shortened due to the increase in temperature of the interior of the elastic layer, energy saving is adversely affected due to lower energy saving effects, and when printing is initiated, the time necessary for print initiation (being a warming-up period) increases due to an increase in required time for warming up the fixing apparatus.

In recent years, in order to overcome the aforesaid problems with such contact heating roller type fixing apparatus, the fixing unit described below has become commercially available. An on-demand type-fixing unit, comprised of a combination of a ceramic heater having a small heat capacity and film, has been realized. Namely, during stand-by, electricity is applied to the heater only for preliminary heating, and only when necessary, for example, when paper sheets are supplied, electricity is supplied to the heater.

However, in the on-demand fixing system employing a seamless film, the problems described below have occurred. Electrostatic off-setting phenomena occur in which toner on a transfer material is electrostatically transferred onto the fixing roller or the fixing film. Further, the bleeding efficiency of releasing agents from toner decreases due to a lower fixing load, compared to conventional fixing systems, whereby off-setting tends to occur. Particularly, fixing members are stained by slight off-setting, which is not detected on images, resulting in a decrease in life. Due to these drawbacks, fixing apparatuses employing the system have not been commonly applied to high speed printers or to high speed copiers.

Recently, in order to achieve energy saving systems, low temperature fixing techniques have been noted. However, when taking into account an increase in speed of the printing process at low temperature, specifically off-setting properties are greatly affected depending on the characteristics of the employed toners. In the low temperature fixing system as described above, problems occur in which when toner comprised of conventional resins is employed, cold off-setting tends to occur due to excessively high elasticity. On the other hand, when as a characteristic of resins, elasticity is designed to be much lower than the necessary value, it becomes difficult to achieve optimal tradeoff between off-setting resistance and storage stability of toner due to flocculation and fusion of toner during storage.

SUMMARY OF THE INVENTION

An object of the present invention is to provide an electrostatic image developing toner which exhibits a wider fixing temperature range, excellent off-setting resistance as well as fixing properties, excellent storage properties and background stain resistance, and minimizes unpleasant odors, and an image forming method using the same.

The present invention and the embodiments thereof will now be described.

A toner production process comprises a process in which a resin is produced by polymerizing a polymerizable monomer in an aqueous medium.

A toner production process comprises a process in which a resin is produced by polymerizing a polymerizable monomer in an aqueous medium, and a process in which a toner, which has been separated from a solvent, is dried under reduced pressure.

Said toner may preferably be applied to an image forming method which comprises a process in which an electrostatic image is formed on an electrostatic image bearing body, a process in which said electrostatic image is developed employing a developer comprised of an electrostatic image developing toner to form a toner image, and a process in which said toner image is transferred onto a transfer body.

BRIEF DESCRIPTION O THE DRAWING

FIG. 1 is a schematic view of the image forming apparatus in which an intermediate transfer material is provided.

DETAILED DESCRIPTION OF THE INVENTION

An electrostatic image developing toner (hereinafter occasionally referred to simply as a toner) comprises an organic silanol compound represented by formula (1) in an amount of 0.001 to 1.0 percent by weight.

$$R_mSi(OH)_n \quad (1)$$

$$R_mSi(OH)_n \quad (1)$$

wherein R represents a hydrocarbon group containing an alkyl group, a vinyl group, a glycidyloxy group, or a methacrylic acid, m and n each represents an integer of 1 to 3, and when m is 2 or 3, R may be the same or different.

The inventors conducted investigations specifically to improve off-setting resistance during fixing at lower temperature and storage stability of toner, as well as to minimize unpleasant odors. As a result, it was discovered that fixability at lower temperature and storage stability of toner are simultaneously improved by allowing organic silanol compounds to be present in the interior of toner particles in specified amounts. In addition, from the viewpoint of a decrease in unpleasant odors generated from the toner, it is critical that the content of said organic silanol compounds is from 1 to 20 ppm by weight of based on the total amount of the toner.

Details of organic silanol compounds represented by formula (1) in toner have not yet been clarified. However, they function as a dispersibility enhancing agent for releasing agents in toner. As a result, it is assumed that they contribute to enhancement of off-setting resistance during low temperature fixing. In addition, they simultaneously contribute to enhancement of storage stability as well as charging stability of toner.

The compounds represented by formula (1) according to the present invention will now be described.

In formula (1), R represents a hydrocarbon group containing an alkyl group, a vinyl group, a glycidyloxy group, or a methacrylic acid, m and n each represents an integer of 1 to 3. Compounds having m of 3 are called 3-function silanols, while those having m of 2 are called 2-function silanols.

Organic silanol compounds are generally employed in the form of alkoxy silane $R_nSi(OR')_m$ wherein R represents an alkyl group and undergo hydrolysis. Accordingly there are compounds which undergo only partial hydrolysis as well as oligomers. However, silanol compounds according to the present invention include those compounds.

Listed as specific examples of organic silanol compounds may be trimethylsilanol, triethylsilanol, t-butyldimethylmethylsilanol, triisopropylsilanol, tri-t-butylsilanol, dimethyldihydroxy silane, diisopropyldihydroxy silane, and di-t-butyldihydroxy silane. The preferable examples are trimethylsilanol, t-butyldimethylmethylsilanol, and triisopropylsilanol.

Organic silanol compounds may be easily synthesized by a person skilled in the art. In addition, the compounds are commercially available.

The content of organic silanol compounds is from 1 to 20 ppm with respect to toner, and is preferably from 5 to 15 ppm. The aforesaid content is preferred from the viewpoint of exhibiting the effects of the present invention, maintaining optimal softness of toner, enhancing storage stability and fixing ratio of toner, and minimizing unpleasant odors.

The aforesaid silanol compounds are added to toner materials preferably in an amount of 10 to 50 ppm during the toner production process. By so doing, dispersibility of releasing agents (being a wax) in toner is enhanced and preferred silanol compound content in toner is achieved after drying under reduced pressure, whereby minimal problems with unpleasant odors as toner occur.

The aforesaid organic silanol compounds are preferably added during preparation of resin particles and added to polymerizable monomers. It is possible to list methods which introduce silanol compounds into particles.

In order to achieve the content of the compounds represented by formula (1) in toner in an amount of 1 to 20 ppm, it is preferable to employ the vacuum drying process described below as a toner drying process.

Organic silanol compounds are quantitatively analyzed employing the analytical method used in common gas chromatograph such as an inner standard method while using a head space system. In this method, toner is sealed in a vessel and subsequently heated approximately to the temperature used during thermal fixing in copiers. When the vessel is filled with volatilities, the resulting volatilities are immediately injected into a gas chromatograph to determine each of the volatility amounts. At the same time, the volatilities are subjected to MS (mass spectroscopy).

The head space gas chromatographic measurement method will now be described.

<Head Space Gas Chromatographic Measurement Method>

1. Sampling Samples

Charged in a 20-ml vial for head space is 0.8 g of a sample. The weight of the sample is measured to the second decimal of 0.01 (since it is necessary to calculate the area per unit weight). The vial is sealed with a septum.

2. Heating Samples

Samples are placed in a thermostat at 170° C. so that each vial remains erect and are heated for 30 minutes.

3. Setting of Gas Chromatograph Separation Conditions

A column having an inner diameter of 3 mm and a length of 3 m, filled with carriers which are coated with silicone oil SE-30 so as to achieve a weight ratio of 15 is employed as a separation column. The resulting separation column is installed in the gas chromatograph, and He, as a carrier, is allowed to flow at a rate of 50 ml/minute. The separation column is heated to 40° C. and subsequently measurements are carried out while raising the temperature to 200° C. at a rate of 10° C./minute. After reaching 200° C., the temperature is maintained for 5 minutes.

4. Introduction of Sample

The vial is removed from the thermostat, and immediately 1 ml of gas, generated from the sample, is collected employing a gas tight syringe. Subsequently, the collected gas is injected into the above mentioned column.

5. Calculation

In advance, a calibration curve is prepared employing an organic silanol compound utilized as an inner standard material. The concentration of each component is determined based on the corresponding calibration curve.

6. Apparatus and Material (1) Head Space Conditions

Head Space Apparatus

HP7694 "Head Space Sampler" manufactured by Hewlett-Packard Corp.

Temperature Conditions

Transfer line: 200° C.

Loop temperature: 200° C.

Sample Amount: 0.8 g/20 ml vial (2) GC/MS Conditions

GC: HP5890 manufactured by Hewlett-Packard Corp.

MS: HP5971 manufactured by Hewlett-Packard Corp.

Column: HP-624, 30 m×0.25 mm

Oven temperature: 40° C. (maintained for 3 minutes)—rising 10° C./minute—to 200° C.

Measurement mode: SIM

Toner and its Production

The toner of the present invention may be prepared employing a method in which fine polymerization particles are prepared employing a suspension polymerization method, or a method in which monomers undergo emulsion polymerization in a solution to which an emulsified composition of necessary additives is added, and thereafter, association is carried out by adding organic solvents, coagulants, and the like. During said association, listed are methods in which preparation is carried out in such a manner that a dispersion of releasing agents, colorants, and the like, which are required to constitute a toner, is mixed and association is carried out, emulsion polymerization is carried out upon dispersing toner components such as releasing agents, colorants, and the like into monomers, and the like. Said association as described herein denotes that a plurality of resin particles and colorant particles are allowed to fusing with each other.

Suspension Polymerization

When the toner is produced by the suspension polymerization method, the production is performed by the following procedure. Various raw materials such as a colorant, a mold releasing agent according to necessity, a charge controlling agent and a polymerization initiator are added into a polymerizable monomer and dispersed or dissolved by a homogenizer, a sand mill, a sand grinder or a ultrasonic dispersing apparatus. The polymerizable monomer in which the raw materials are dissolved or dispersed is dispersed into a form of oil drops having a suitable size as toner particle by a homo-mixer or a homogenizer in an aqueous medium containing a dispersion stabilizing agent. Then the dispersion is moved into a reaction vessel having a stirring device with double stirring blades, and the polymerization reaction is progressed by heating. After finish of the reaction, the dispersion stabilizing agent is removed from the polymer particles and the polymer particles are filtered, washed and dried to prepare a toner. In the invention, the "aqueous medium" is a medium containing at least 50% by weight of water.

Emulsion Polymerization

The toner according to the invention can be also obtained by salting-out/fusing resinous particles prepared in an aqueous medium.

For example, the methods described in JP O.P.I. Nos. 5-265252, 6-329947 and 9-15904 are applicable. The toner can be produced by a method by which dispersed particles of constituting material such as resinous particles and colorant or fine particles constituted by resin and colorant are associated several by several. Such the method is realized particularly by the following procedure: the particles are dispersed in water and the particles are salted-out by addition of a coagulation agent in an amount of larger than the critical coagulation concentration. At the same time, the particles are gradually grown by melt-adhesion of the particles by heating at a temperature higher than the glass transition point of the produced polymer. The particle growing is stopped by addition of a large amount of water when the particle size is reached at the prescribed diameter. Then the surface of the particle is made smooth by heating and stirring to control the shape of the particles. The particles containing water in a fluid state are dried by heating. Thus the toner can be produced. In the foregoing method, an infinitely water-miscible solvent such as alcohol may be added together with the coagulation agent.

It is preferable to employ a method in which salting-out/fusing the complex resinous fine particles, obtained by polymerizing monomers containing a crystalline substance in the monomers, and colorant particles. The crystalline substance is dissolved or melted in the monomers.

The representative preparation method of the toner is salting-out/fusing the complex resinous fine particles obtained by multi-step polymerization and colorant particles. The multi-step polymerization will be described more in detail below.

Preparation Method of Composite Resinous Particles Obtained by a Multi-step Polymerization The production process comprises, for example, the following processes:

1. A multi-step polymerizing process
2. A salting-out/fusion process to produce toner particles by salting-out/fusing the composite resinous particles and colored particles
3. Filtering and washing processes to filter the toner particles from the toner particle dispersion and to remove a unnecessary substance such as the surfactant from the toner particles
4. A drying process to dry the washed toner particles
5. A process to add an exterior additive to the toner particles Each of the processes is described below.

(Multi-step Polymerization Process)

The multi-step polymerization process is a process for preparing the composite resinous particle having broader molecular weight distribution so as to obtain enhanced anti-off-set characteristics. A plural of polymerization reaction is conducted in separate steps so that each particle has different layers having different molecular weight. The obtained particle has a gradient of molecular weight from the center to the surface of the particle. For example, a lower molecular weight surface layer is formed by adding a polymerizable monomer and a chain transfer agent after obtaining a higher molecular weight polymer particles dispersion.

It is preferred from the viewpoint of the stability and the anti-crush strength of the obtained toner to apply the multi-step polymerization including three or more polymerization steps. The two- and tree-step polymerization methods, which are representative examples, are described below. It is preferable that the closer to the surface the molecular weight is lower in view of the anti-crush strength.

(Two-step Polymerization Method)

The two-step polymerization method is a method for producing the composite resinous particle comprised of the central portion (core) comprising the high molecular weight resin and an outer layer (shell) comprising the low molecular weight resin. The central portion (core) may contain a releasing agent or a crystalline material.

In concrete, a monomer liquid is dispersed in an aqueous medium (an aqueous solution of a surfactant) in a form of oil drop, and the system is subjected to a polymerization treatment (the first polymerization step) to prepare a dispersion of a higher molecular weight resinous particles each containing the crystalline material. In case that the core portion contains the releasing agent or crystalline material, these are incorporated in the monomer liquid.

Next, a polymerization initiator and a monomer to form the lower molecular weight resin is added to the suspension of the resin articles, and the monomer is subjected to a polymerization treatment (the second polymerization step) to form a covering layer composed of the lower molecular weight resin (a polymer of the monomer) onto the resinous particle.

(Three-step Polymerization Method)

The three-step polymerization method is a method for producing the composite resinous particle comprised of the central portion (core) comprising the high molecular weight resin, the inter layer containing the middle molecular weight resin and the outer layer (shell) comprising the low molecular weight resin. The inter layer may contain the releasing agent or crystalline material.

In concrete, a suspension of the resinous particles prepared by the polymerization treatment (the first polymerization step) according to a usual procedure is added to an aqueous medium (an aqueous solution of a surfactant) and a monomer liquid is dispersed in the aqueous medium. The aqueous dispersion system is subjected to a polymerization treatment (the second polymerization step) to form a covering layer (inter layer) comprising a resin (a polymer of the monomer) onto the surface of the resinous particle (core particle). The releasing agent or crystalline material may be incorporated in the monomer liquid. Thus a suspension of combined resin (higher molecular weight resin-middle molecular weight resin) particles is prepared so that the inter layer contains these.

Next, a polymerization initiator and a monomer to form the lower molecular weight resin is added to the dispersion of the combined resinous particles, and the monomer is subjected to a polymerization treatment (the third polymerization step) to form a covering layer composed of the low molecular weight resin (a polymer of the monomer) onto the composite resinous particle.

In the three-step polymerization method, the releasing agent or crystalline material can be finely and uniformly dispersed in case that the releasing agent or crystalline material is incorporated in the monomer liquid for forming the inter layer.

The polymer is obtained by polymerization in the aqueous medium. The monomer liquid is dispersed in the aqueous medium as oil drop at the time of forming resinous particles (core) or covering layer thereon (inter layer), and resinous particles can be obtained as latex particles by polymerization treatment with the addition of initiator.

The water based medium means one in which at least 50 percent, by weight of water, is incorporated.

Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

Methods are preferred in which dispersion is carried out employing mechanical force. Said monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the crystalline material dissolved in oil phase tends to desorb. On the other hand sufficient amount of the crystalline material can be incorporated in a resinous particle or covered layer by the mini-emulsion method in which oil droplets are formed mechanically.

Herein, homogenizers to conduct oil droplet dispersion, employing mechanical forces, are not particularly limited, and include, for example, "CLEARMIX" manufactured by M-Technique Co., Ltd., ultrasonic homogenizers, mechanical homogenizers, and Manton-Gaulin homogenizers and pressure type homogenizers.

The diameter of dispersed particles is 10 to 1,000 nm, and is preferably 30 to 300 nm.

Emulsion polymerization, suspension polymerization seed emulsion etc. may be employed as the polymerization method to form resinous particles or covered layer containing the crystalline material. These polymerization methods are also applied to forming resinous particles (core particles) or covered layer which do not contain the crystalline material.

The particle diameter of composite particles obtained by this process is preferably from 10 to 1,000 nm in terms of weight average diameter determined employing an electrophoresis light scattering photometer "ELS-800" (produced by Otsuka Electronics Co., Ltd.).

Glass transition temperature (Tg) of the composite resinous particles is preferably from 48 to 74° C., more preferably from 52 to 64° C., and particularly preferably from 52 to 64° C.

The Softening point of the composite resinous particles is preferably from 95 to 140° C.

The toner of this invention is preferably obtained by salting-out/fusion process in which resin particles are fused on the surface of resin and colorant particles to form a resin layer. THe method is described more in detail.

<Salting-out/Fusion Process>

Salting-out/fusion process is a process to obtain toner particles having undefined shape (aspherical shape) in which the composite resinous particles obtained by the foregoing process and colored particles are aggregated through salting-out/fusion process, wherein the salting-out and fusion processes are caused simultaneously.

Salting-out/fusion process of the invention is that the processes of salting-out (coagulation of fine particles) and fusion (distinction of surface between the fine particles) occur simultaneously, or the processes of salting-out and fusion are induced simultaneously. Particles (composite resinous particles and colored particles) must be subjected to coagulation in such a temperature condition as lower than the glass transition temperature (Tg) of the resin composing the composite resinous particles so that the processes of salting-out (coagulation of fine particles) and fusion (distinction of surface between the fine particles) occur simultaneously.

Particles of additives incorporated within toner particles such as a charge control agent (particles having average diameter from 10 to 1,000 nm) may be added as well as the composite resinous particles and the colored particles in the salting-out/fusion process. Surface of the colored particles may be modified by a surface modifier.

<Digestion Process>

The digestion process is a process following to the salting-out/fusion process, wherein the crystalline material is subjected to phase separation by continuing agitation with constant strength keeping temperature close to the melting point of the crystalline material, preferably plus minus 20 centigrade of the melting point, after the coagulation of fine particles. The shape coefficient and variation coefficient thereof, may be controlled in this process.

Further, the total amount of metal elements employed as said salting-out agents and for example, the monovalent metal element added as said salting-out termination agent is preferably from 350 to 35,000 ppm in terms of a chloride.

The content of the remaining metal ion in toner can be obtained by determining the fluorescent X-ray intensity emitted from the metal element (for example, calcium in calcium chloride), as well as the fluorescent X-ray intensity of the corresponding base, employing a fluorescent X-ray spectrometer System 3270 Type•(manufactured by Rigaku Denki Kogyo Co.). For performing the fluorescent X-ray measurement, a WDX System 3080 manufactured by Rigaku Denki Co. is used in the following conditions.

One specific measurement method is as follows. A plurality of toners, of which content ratio of an inorganic salt is previously known, is prepared, and 5 g of each toner is pelletized. Subsequently, employing the resultant pellets, the relationship (in the form of a calibration curve) between the content ratio (weight ppm) of said inorganic salt and the fluorescent X-ray intensity (being the peak intensity), emitted from said inorganic salt, is determined. Thereafter, toner (being a sample), of which content ratio of an inorganic salt is to be determined, is pelletized in the same manner as above and the fluorescent X-ray intensify emitted from said inorganic salt is determined, whereby it is possible to obtain a content ratio, namely the amount of the remaining metal ion in the toner.

<Filtration and Washing Process>

In said filtration and washing process, filtration is carried out in which said toner particles are collected from the toner particle dispersion, and washing is also carried out in which additives such as surface active agents, salting-out agents, and the like, are removed from the collected toner particles (a cake-like aggregate).

Herein, filtering methods are not particularly limited, and include a centrifugal separation method, a vacuum filtration method which is carried out employing Buchner funnel and the like, a filtration method which is carried out employing a filter press, and the like.

<Drying Process>

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

Drying condition, temperature, reduce pressure time and so on, is suitably selected as far as the temperature does not exceed Tg of the resin used in the toner particles.

Further, when dried toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

The toner according to the invention is preferably produced by the following procedure, in which the composite resinous particle is formed in the presence of no colorant, a dispersion of the colored particles is added to the dispersion of the composite resinous particles and the composite resinous particles and the colored particles are salted-out and coagulated.

In the foregoing procedure, the polymerization reaction is not inhibited since the preparation of the composite resinous particle is performed in the system without colorant. Consequently, the anti-offset property is not deteriorated and contamination of the apparatus and the image caused by the accumulation of the toner is not occurred.

Moreover, the monomer or the oligomer is not remained in the toner particle since the polymerization reaction for forming the composite resinous particle is completely performed. Consequently, any offensive odor is not occurred in the fixing process by heating in the image forming method using such the toner.

Further, images excellent in sharpness can be obtained for long period of time since the surface of the toner particles are uniform and charge distribution curve is sharp. An offset property and adhesion of paper to a fixing roller are improved and an image of suitable glossiness is obtained with maintaining good fixing ability in the image formation method employing heating and contact type fixing process by employing the toner in which composition, molecular weight and surface property are uniform between toner particles.

Each of the constituting materials used in the toner producing process is described in detail below.

(Polymerizable Monomer)

A hydrophobic monomer is essentially used as the polymerizable monomer for producing the resin or binder used in the invention and a cross-linkable monomer is used according to necessity. As is described below, it is preferable to contain at least one kind of a monomer having an acidic polar group and a monomer having a basic polar group.

(1) Hydrophobic Monomer

The hydrophobic monomer can be used, one or more kinds of which may be used for satisfying required properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like. Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Monomer Having an Acidic Polar Group

As the monomer having an acidic polar group, (a) a polymerizable monomer containing a carboxylic acid group (—COOH) and (b) a polymerizable monomer containing a sulfonic acid group (—$SO_3H$) can be cited.

Examples of the polymerizable monomer containing the carboxylic acid group (—COOH) of (a) include acrylic acid, methacrylic acid, fumaric acid, maleic acid, itaconic acid, cinnamic acid, maleic acid mono-butyl ester, maleic acid mono-octyl ester and their sodium salts, zinc salts, etc.

Examples of the polymerizable monomer containing the sulfonic acid group (—$SO_3H$) of (b) include sulfonated styrene and its Na salt, allylsulfo succinic acid, allylsulfo succinic acid octyl ester and their sodium salts.

(4) Monomer Having a Basic Polar Group

As the monomer having a basic polar group, can be cited (i) (meth)acrylic acid ester obtained by reacting (meth) acrylic acid with an aliphatic alcohol, which has 1 to 12 carbon atoms, preferably 2 to 8 carbon atoms, specifically preferably 2 carbon atoms, and which also has an amino group or a quaternary ammonium group, (ii) (meth)acrylic acid amide or (meth)acrylic acid amide having mono-alkyl group or di-alkyl group, having 1 to 18 carbon atoms, substituted on its N atom, (iii) vinyl compound substituted with a heterocyclic group having at least a nitrogen atom in said heterocyclic group, (iv) N,N-di-allyl-alkylamine or its quaternary salt. Of these, (meth)acrylic acid ester obtained by reacting (meth)acrylic acid with the aliphatic alcohol having the amino group or the quaternary ammonium group is preferred.

Examples of (meth)acrylic acid ester obtained by reacting (meth)acrylic acid with the aliphatic alcohol having the amino group or the quaternary ammonium group of (i) include dimethylaminoethylacrylate, dimethylaminoethylmethacrylate, diethylaminoethylacrylate, diethylaminoethylmethacrylate, quaternary ammonium salts of the above mentioned four compounds, 3-dimethylaminophenylacrylate and 2-hydroxy-3-methacryloxypropyl trimethylammonium salt, etc.

Examples of (meth)acrylic acid amide or (meth)acrylic acid amide having mono-alkyl group or di-alkyl group substituted on its N atom of (ii) include acrylamide, N-butylacrylamide, N,N-dibutylacrylamide, piperidylacrylamide, methacrylamide, N-butylmethacrylamide, N,N-dimethylacrylamide, N-octadecylacrylamide, etc.

Examples of vinyl compound substituted with a heterocyclic group having at least a nitrogen atom in said heterocyclic group of (iii) include vinylpyridine, vinylpyrrolidone, vinyl-N-methylpyridinium chloride, vinyl-N-ethylpyridinium chloride, etc.

Examples of N,N-di-allyl-alkylamine or its quaternary salt of (iv) include N,N-di-allyl-methylammonium chloride, N,N-di-allyl-ethylammonium chloride, etc.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like. Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 90° C. is employed. However, by employing a combination of polymerization initiators such as hydrogen peroxide-reducing agent (ascorbic acid and the like), which is capable of initiating the polymerization at room temperature, it is possible to carry out polymerization at least room temperature.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

Further, in addition to the above, a nonionic surface active agent can be used. To state it concretely, polyethylene oxide, polypropylene oxide, a combination of polypropylene oxide and polyethylene oxide, ester of polyethylene glycol and higher fatty acid, alkylphenolpolyethylene oxide, ester of higher fatty acid and polyethylene glycol, ester of higher fatty acid and polypropyrene oxide, sorbitan ester, etc. can be cited.

Further, these surface active agents are used mainly at the time of emulsion polymerization, but they may be used in some other processes or for other purposes.

(Molecular Weight Distribution of Resinous Particles and Toner)

Resins used in the toner has a peak or a shoulder within the ranges of preferably from 100,000 to 1,000,000 and from 1,000 to 50,000, and more preferably in the ranges from 100,000 to 1,000,000, from 25,000 to 150,000 and from 1,000 to 50,000 in the molecular weight distribution.

The resinous particles preferably comprises "a high molecular weight resin" having a peak or a shoulder within the range of from 100,000 to 1,000,000, and "a low molecular weight resin" having a peak or a shoulder within the range of from 1,000 to 50,000, and more preferably "a middle molecular weight resin" having a peak or a shoulder within the range of from 15,000 to 100,000, in the molecular weight distribution.

Molecular weight of the resin composing toner is preferably measured by gel permeation chromatography (GPC) employing tetrahydrofuran (THF).

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 $\mu$m, the filtrate is injected in a GPC.

Measurement conditions of GPC are described below. A column is stabilized at 40° C., and THF is flowed at a rate of 1.0 ml per minute. Then measurement is carried out by injecting approximately 100 μl of said sample at a concentration of 1 mg/ml. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

The coagulants employed in the present invention are preferably selected from metallic salts. Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application.

A divalent metal salts have smaller critical coagulation concentration (coagulation value or coagulation point) than those of monovalent metal salts, and the trivane metal salts have smallest.

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ζ potential of the dispersion, and in addition the critical coagulation concentration may be obtained as the salt concentration which initiates a variation in the ζ potential.

The dispersion of the polymerized resinous particles are treated by the metal salt with concentration at least the critical coagulation concentration. The metal salt may be added ad itself directly or in the form of aqueous solution for the purpose. The concentration of the metal salt must be greater than the critical coagulation concentration based on the whole volume of the dispersion and the aqueous solution of the metal salt.

In the present invention, the concentration of salting-out agents is commonly more than or equal to the critical aggregation concentration, is preferably at least 1.2 times the critical aggregation concentration, and is more preferably at least 1.5 times.

(Colorants)

The toner is obtained by salting out/fusing the composite resinous particles and colored particles.

Listed as colorants which constitute the toner of the present invention may be inorganic pigments, organic pigments, and dyes.

Employed as said inorganic pigments may be those conventionally known in the art. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

The magnetite can be added to the resinous particles when the toner is used as a magnetic toner. In this instance the magnetite is added in an amount of from 20 to 60 weight % of the toner particle in view of obtaining necessary magnetic characteristics.

The organic pigment or organic dye is also employed, examples thereof are listed.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, Pigment Yellow 155, Pigment Yellow 186, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones. Further, the added amount of pigments is commonly between 2 and 20 percent by weight, and is preferably between 3 and 15 percent by weight.

Said colorants may also be employed while subjected to surface modification. As said surface modifying agents may be those conventionally known in the art, and specifically, preferably employed may be silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand PLENACT TTS, 9S, 38S, 41B, 46B, 55, 138S, 238S etc., by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include PLENACT AL-M.

These surface modifiers is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

(Releasing Agent)

Toner employed in the invention is preferably prepared by fusing resinous particles containing a releasing agent and colored particles in water based medium and then digesting the obtained particles whereby the releasing agent and the colorant are dispersed in resin matrix adequately to form a domain-matrix structure.

Toner particles having the crystalline substance dispersed finely can be obtained by subjecting the resinous particles containing the crystalline substance and the colored particles to salting-out/fusion in the aqueous medium.

Preferable examples of the crystalline material having releasing property include low molecular weight polypropylene having average molecular weight of 1,500 to 9,000 and low molecular weight polyethylene, and a particularly preferable example is an ester compounds represented by General Formula (2), described below.

$$R^1—(OCO—R^2)_n \quad (2)$$

wherein n represents an integer of 1 to 4, and preferably 2 to 4, more preferably 3 or 4, and in particular preferably 4, $R^3$ and $R^4$ each represent a hydrocarbon group which may have a substituent respectively. $R^1$ has from 1 to 40 carbon atoms, and preferably 1 to 20, more preferably 2 to 5. $R^2$ has from 1 to 40 carbon atoms, and preferably 16 to 30, more preferably 18 to 26.

The representative examples are listed.

1)

$$CH_3—(CH_2)_{12}—COO—(CH_2)_{17}—CH_3$$

2)

$$CH_3—(CH_2)_{18}—COO—(CH_2)_{17}—CH_3$$

3)

$$CH_3—(CH_2)_{20}—COO—(CH_2)_{21}—CH_3$$

4)

$$CH_3—(CH_2)_{14}—COO—(CH_2)_{19}—CH_3$$

-continued

5)

$$CH_3—(CH_2)_{20}—COO—(CH_2)_6—O—CO—(CH_2)_{20}—CH_3$$

6)

$$CH_3—(CH_2)_{20}—COO—(CH_2)_2—\underset{}{\overset{CH_3}{\overset{|}{C}}}H—CH_2—O—CO—(CH_2)_{20}—CH_3$$

7)

$$CH_3—(CH_2)_{22}—COO—(CH_2)_2—\overset{CH_3}{\overset{|}{C}}H—CH_2—O—CO—(CH_2)_{22}—CH_3$$

8)

$$CH_3—(CH_2)_{22}—COO—CH_2—\overset{CH_3}{\underset{CH_3}{C}}—CH_2—O—CO—(CH_2)_{22}—CH_3$$

9)

$$CH_3—(CH_2)_{26}—COO—CH_2—\overset{CH_3}{\underset{CH_3}{C}}—CH_2—O—CO—(CH_2)_{26}—CH_3$$

10)

$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

11)

$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

12)

$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

13)

$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

14)

$$\begin{array}{l} CH_2—OH \\ | \\ CH—OH \\ | \\ CH_2—O—CO—(CH_2)_{26}—CH_3 \end{array}$$

15)

$$\begin{array}{l} CH_2—OH \\ | \\ CH—OH \\ | \\ CH_2—O—CO—(CH_2)_{22}—CH_3 \end{array}$$

16)

$$CH_3—(CH_2)_{26}—COO—CH_2—\overset{CH_3}{\underset{CH_2—O—CO—(CH_2)_{26}—CH_3}{C}}—CH_2—O—CO—(CH_2)_{26}—CH_3$$

-continued

17)

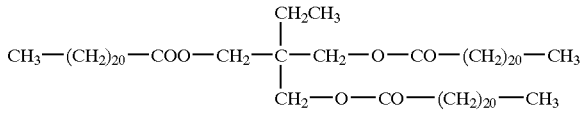

18)

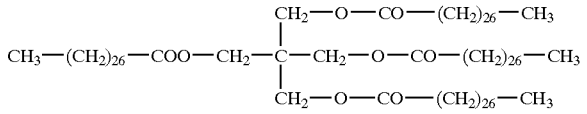

19)

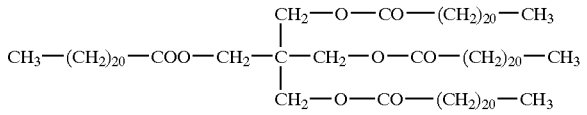

20)

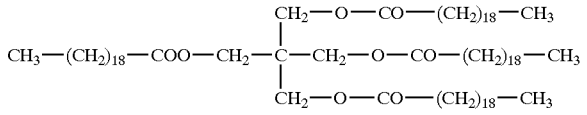

21)

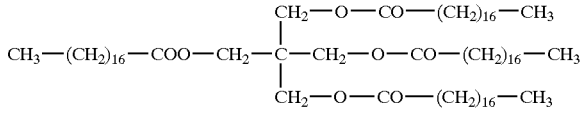

22)

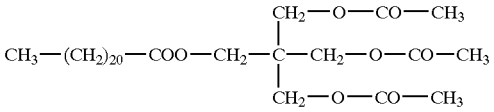

As a containing ratio of the compound in the toner, it is preferable that releasing agent is from 1 to 30 percent by weight, and more preferably from 2 to 20 percent by weight, and in particular from 3 to 15 percent by weight of toner weight as a whole.

The releasing agent is preferably incorporated in resin particles during mini-emulsion process, and the toner particles are prepared by salting-out/fusing the resin particles containing the releasing agent as well as colorant.

It is possible to add materials to endow various function other than a coloring agent and a releasing agent. Concretely, a charge controlling agent is mentioned. This material can be added at the same time as addition of colorant during the salting-out/fusing, or directly to the resin particles.

Various kinds of charge controlling agent can be used; for example, a Nigrosine dye, a metal salt of naphthenic acid, or higher fatty acid, alkoxyamine, a quaternary ammonium salt compound, azo metallic complex, a metallic salt of salicilic acid or its metallic complex, etc. can be cited.

(External Additives):

It is possible to use what is called an external additive to be added in a toner of this invention for the purpose of improving fluidity or raising the cleaning performance. As regards this external additive, there is no particular limitation, and various kinds of inorganic fine particles, organic fine particles, and a lubricant can be used.

For the inorganic fine particles, those of any kind known to public can be used. To state it concretely, fine particles of silica, titania, aluminum, etc. can be desirably used. For these fine particles, hydrophobic ones are desirable.

To state it concretely, as for the silica fine particles, for example, products on the market produced by Nihon Aerosil Co., Ltd. R-805, R-976, R-974, R-972, R-812, and R-809, products produced by Hoechst CmbH HVK-2150 and H-200, products on the market produced by Cabot Corp. TS-720, TS-530, TS-610, H-5, and MS-5, etc. can be cited.

For the titania fine particles, for example, products on the market produced by Nihon Aerosil Co., Ltd. T-805 and T-604, products on the market produced by TAYCA Corp. MT-100S, MT-100B, MT-500BS, MT-600, MT-600SS, and JA-1, products on the market produced by Fuji Titanium Industry Corp. TA-300SI, TA-500, TAF-130, TAF-510, and TAF-510T, products on the market produced by Idemitsu Kosan Co., Ltd. IT-S, IT-OA, IT-OB, and IT-OC, etc. can be cited.

For the alumina fine particles, for example, products on the market produced by Nihon Aerosil Co., Ltd. RFY-C and C-604, a product on the market produced by Ishihara Sangyo Kaisha, Ltd. TO-55, etc. can be cited.

For the organic fine particles, it is possible to use spherical organic fine particles having a number-average primary particle diameter of about 10 to 2000 nm. To state it concretely, fine particles of a homopolymer of styrene, methyl methacrylate, etc. or a copolymer of these can be used.

As regards the lubricant, for example, metallic salts of higher fatty acids such as stearic acid salts of metals such as zinc, aluminum, copper, magnesium, and calcium, oleic acid salts of metals such as zinc, manganese, iron, copper, and magnesium, palmitic acid salts of metals such as zinc, copper, magnesium, and calcium, linoleic acid salts of metals such as zinc and calcium, and ricinoleic acid salts of metals such as zinc and calcium can be cited.

It is desirable that the quantity of these external additives to be added is about 0.01 to 5% by weight to the toner.

(Other External Additives)

This is a process to add external additives to dried toner particles.

These are added by means of various kinds of mixing apparatus such as a turbular mixer, a Henscel mixer, a nouter mixer, and a V-type mixing machine.

(Toner Particles)

Number average diameter of the toner particle is preferably from 3 to 10 $\mu$m, more preferably from 3 to 8 $\mu$m. Particle diameter is controlled by adjusting concentration of coagulant (salting agent), amount of organic solvent, fusing time, composition of polymer during the toner preparation.

Number of fine toner particles having strong adhesion which fly to heating device and generate off-set is reduced, and high transfer performance is obtained whereby image quality of half tone, fine line, dot and so on is improved by employing the toner having average diameter of 3 to 10 $\mu$m. Particle diameter is controlled by adjusting concentration of coagulant (salting agent), amount of organic solvent, fusing time, composition of polymer during the toner preparation.

It is possible to determine said volume average particle diameter of toner particles, employing a Coulter Counter TA-II, a Coulter Multisizer, SLAD 1100 (a laser diffraction type particle diameter measuring apparatus, produced by Shimadzu Seisakusho), and the like.

Herein values are shown which are obtained based on the particle diameter distribution in the range of 2.0 to 40 $\mu$m, employing an aperture having an aperture diameter of 100 $\mu$m of said Coulter Counter TA-II as well as said Coulter Multisizer.

(Preferable Shape Coefficient of Toner Particles)

The toner of this invention preferably has at least 65% by number of particles having shape coefficient of from 1.0 to 1.6, more preferably at least 65% by number of particles having shape coefficient of from 1.2 to 1.6, and particularly preferably at least 70% by number of particles having shape coefficient of from 1.2 to 1.6.

The shape coefficient of the toner particles is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane. The shape coefficient was determined in such a manner that toner particles were photographed under a magnification factor of 2,000, employing a scanning type electron microscope, and the resultant photographs were analyzed employing "Scanning Image Analyzer", manufactured by JEOL LTD. At that time, 100 toner particles were employed and the shape coefficient was obtained employing the aforementioned calculation formula.

The toner of the present invention preferably has a sum M of at least 70 percent. Said sum M is obtained by adding relative frequency m1 of toner particles, included in the most frequent class, to relative frequency m2 of toner particles included in the second frequent class in a histogram showing the particle diameter distribution, which is drawn in such a manner that natural logarithm lnD is used as an abscissa, wherein D (in $\mu$m) represents the particle diameter of a toner particle, while being divided into a plurality of classes at intervals of 0.23, and the number of particles is used as an ordinate.

By maintaining the sum M of the relative frequency m1 and the relative frequency m2 at no less than 70 percent, the variance of the particle diameter distribution of toner particles narrows. As a result, by employing said toner in an image forming process, the minimization of generation of selective development may be secured.

In the present invention, the above-mentioned histogram showing the particle diameter distribution based on the number of particles is one in which natural logarithm lnD (wherein D represents the diameter of each particle) is divided at intervals of 0.23 into a plurality of classes (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ), being based on the number of particles. Said histogram was prepared in such a manner that particle diameter data of a sample measured by a Coulter Multisizer according to conditions described below were transmitted to a computer via an I/O unit, so that in said computer, said histogram was prepared employing a particle diameter distribution analyzing program.

<Measurement Conditions>

Aperture: 100 $\mu$m

Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured. To prepare the sample, the resulting mixture is subjected to dispersion treatment for one minute employing an ultrasonic homogenizer.

(Developers)

The toner of the present invention may be employed in either a single-component developer or a two-component developer.

Listed as single-component developers are a non-magnetic single-component developer, and a magnetic single-component developer in which magnetic particles having a diameter of 0.1 to 0.5 $\mu$m are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 $\mu$m, and is more preferably 25 to 80 $\mu$m.

The volume average particle diameter of said carrier can be generally determined employing a laser diffraction type particle diameter distribution measurement apparatus "HELOS", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

<Image Forming Method>

An example of an image forming apparatus which can be employed for the image forming method using the toner of he invention.

FIG. 1 is a schematic view of the image forming apparatus in which an intermediate transfer material (transfer belt) is provided.

In the image forming apparatus as shown in FIG. 1 for forming a color image according to the invention, a plurality of image forming units is arranged by each of which visible toner images each having different color is respectively formed and successively transferred in pile onto the same image support member.

In the apparatus, the first, second, third and fourth image forming units Pa, Pb, Pc and Pd are serially arranged and each of the image forming units has an exclusive image carrier or photoreceptor drum 1*a*, 1*b*, 1*c* and 1*d*, respectively. Image forming devices 2*a*, 2*b*, 2*c* and 2*d*, developing devices 3*a*, 3*b*, 3*c* and 3*d*, transfer discharge devices 4*a*, 4*b*, 4*c* and 4*d*, cleaning devices 5*a*, 5*b*, 5*c* and 5*d*, and chargers 6*a*, 6*b*, 6*c* and 6*d*, are respectively arranged around the photoreceptors 1*a* through 1*d*.

In such the constitution, for instance, a latent image of a yellow component of a color original image is firstly formed by the image forming device 2*a* on the photoreceptor drum 1*a* of the first image forming unit Pa. The latent image is developed by a developer containing a yellow toner of the developing device 3*a* to be converted to a visible image and the visible image is transferred to the transfer belt 21 by the transfer discharging device 4*a*.

During the yellow image is transferred onto the transfer belt 21, a latent image of magenta component is formed on the photoreceptor drum 1*b* and converted to a visible image by a developer containing a magenta toner by the developing device 3*b* in the second image forming unit Pb. The visible magenta toner image is transferred to the prescribed position on the transfer belt 21 on which the image formed in the first image forming unit Pa is transferred, when the image support member is introduced to the position of the transfer discharging device 4*b*.

Subsequently, the image formation of a cyan component as well as a black component is carried out in the same manner as the method described above, employing third image forming unit Pc and fourth image forming unit Pd. As a result, on said transfer belt, the cyan toner image and the black toner image are superpose-transferred. When said image transfer is finished, a superposed multicolor image is prepared on said transfer belt 21. On the other hand, photoreceptors 1*a*, 1*b*, 1*c*, and 1*d*, which have finished the transfer, are subjected to removal of any residual toner, employing cleaning units 5*a*, 5*b*, 5*c*, and 5*d*, and are then employed to form the next image formation.

Transfer belt 21 is employed in the image forming apparatus. In FIG. 1, said transfer belt 21 is conveyed from right to left. During said conveyance process, said transfer belt 21 passes through each of transfer discharge sections 4*a*, 4*b*, 4*c*, and 4*d* in each of image forming units Pa, Pb, Pc, and Pd, and each color image is transferred.

When transfer belt 21 passes through fourth image forming unit Pd, an AC voltage is applied to separation charge eliminating unit 22*d*, and said transfer belt 21 is subjected to charge elimination, whereby all toner images are simultaneously transferred onto transfer material P to form a color image.

In FIG. 1, 22*a*, 22*b*, 22*c*, and 22*d* each are a separation charge elimination discharging unit, respectively. Transfer belt 21, which has finished the transfer of toner images, is subjected to removal of the residual toner, employing cleaning unit 24 comprised of a brush type cleaning member in combination with a rubber blade, and is prepared for the next image formation.

Further, as described above, a multicolor superposed image is formed on transfer belt 21 such as a long conveying belt, and the resultant image is simultaneously be transferred onto a transfer material. Alternatively, it may be constituted in such a manner that an independent transfer belt is provided to each of the image forming units, and an image is successively transferred to a transfer material from said each transfer belt.

Further, employed as said transfer belt is a looped film which is prepared as described below. A 5 to 15 $\mu$m thick releasing type layer, the surface resistance of which is adjusted to $10^5$ to $10^8$ Ω by adding conductive agents to a fluorine based or silicone based resin, is provided onto an approximately 20 $\mu$m thick high-resistance film comprised of polyether, polyamide or tetrafluoroethylene-perfluorovinyl ether, having a surface resistance of $10^{14}$ Ω or higher.

In the image forming method of the present invention, as described above, a toner image formed in the development process passes through a transfer process in which said image is transferred onto a transfer material. Subsequently, the transferred image is fixed in a fixing process.

Said heating roller fixing system is constituted of an upper roller and a lower roller. Said upper roller is formed by covering, with tetrafluoroethylene or polytetrafluoroethylene-perfluoroalkoxyvinyl ether copolymers, the surface of a metal cylinder comprised of iron or aluminum, which has a heating source in its interior, and said lower roller is formed employing silicone rubber. The representative example of said heating source is one having a linear heater which heats the surface of said upper roller to about 120 to 200 (C. Pressure between said upper roller and said lower roller is applied in the fixing section and a so-called nip is formed by deformation of said lower roller. The resultant nip width is commonly from 1 to 10 mm, and is preferably from 1.5 to 7 mm. The linear fixing velocity is preferably from 40 to 600 mm/second. When said nip width is less than said lower limit, it becomes difficult to uniformly provide heat to a toner, whereby uneven fixing occurs. On the other hand, when said nip width is greater than said upper limit, problems with excessive off-setting during fixing occur due to the enhancement of melting resins.

Another fixing system such that having a thermal belt as a heating member or having pre-heat mechanism may be employed for the invention than that having a heating roller and a pressure roller described above.

A fixing-cleaning mechanism may be provided. Employed as systems to achieve said mechanism may be a system in which silicone oil is supplied onto the upper fixing roller or film, and a system in which cleaning is carried out utilizing a pad, a roller, or a web each of which are impregnated with silicone oil.

Further, the image forming apparatus, employed in the present invention, may have a mechanism which carries out toner recycling in which a non-transferred toner, which remains on the surface of the photoreceptor, is subjected to recycling. Listed as systems to carry out toner recycling may be, for example, a method in which toner, recovered in the cleaning section, is conveyed employing a conveyer or a conveying screw to a hopper for supplying the toner or a development unit, or is mixed with supply toner in an intermediate chamber and is then supplied to the development unit. Listed as preferred systems may be a system in which recovered toner is directly returned to the development unit, or a system in which recycled toner is mixed with supply toner in the intermediate chamber and is then supplied.

EXAMPLES

The embodiments as well as effects of the present invention will be specifically described with reference to examples.

Example 1

Preparation of Colored Particle 1

(Preparation of Latex)

(1) Preparation of Nucleus Particles (First Step Polymerization)

Charged into a 5,000 ml separable flask fitted with a stirring unit, a temperature sensor, a cooling pipe, and a nitrogen inlet unit was a surface active agent solution (a water-based medium) which was prepared by dissolving 4.0 g of an anionic surface active agent A ($C_{10}H_{21}(OCH_2CH_2)_2OSO_3Na$ in 3,040 g of deionized water. Subsequently, while stirring at 230 rpm, temperature in the flask was raised to 80° C. under a flow of nitrogen.

Added to the resulting surface active agent solution was an initiator solution prepared by dissolving 10.0 g of a polymerization initiator (potassium persulfate: KPS) in 400 g of deionized water, and subsequently, the resulting mixture was heated to 75° C. Thereafter, a monomer mix solution, comprised of 528 g of styrene, 204 g of n-butyl acrylate, 68.0 g of methacrylic acid and 24.4 g of n-octyl-3-mercapto propionate, was added dropwise over one hour. While stirring, the resulting system underwent polymerization (first step polymerization) while heated to 75° C. for two hours, whereby resin particles (a dispersion of resin particles comprised of a high molecular weight resin) were prepared.

The resulting particles were designated as "Latex (1H)".

(2) Formation of the Interlayer (the Second Step Polymerization)

Charged into a flask fitted with a stirring unit were 95.0 g of styrene, 36.0 g of n-butyl acrylate, 9.0 g of methacrylic acid, and 0.59 g of n-octyl-3-mercaptopropionic acid ester, and subsequently, a releasing agent represented by the above mentioned formula 19) and 0.03 g of a trimethyl silanol of the Formula 1 were added to the monomer mix solution and was then dissolved while heated to 90° C., whereby a monomer solution 1 was prepared.

Separately, a surface active agent solution prepared by dissolving 1.0 g of the anionic surface active agent A in 1,560 ml of deionized water was heated to 98° C. Subsequently, 28 g of the Resin Particles (1H) as a solid, which were employed as a dispersion of nucleus particles, was added to the resulting surface active agent solution. The resulting mixture was mixed with the monomer solution 1 and dispersed for 8 hours, employing a mechanical homogenizer "CLEARMIX" (manufactured by M-Technique Co., Ltd.), whereby a dispersion (an emulsion composition), comprising emulsified particles (oil droplets) having dispersion particle diameter of 284 nm was prepared.

Then to the dispersion (emulsion), a polymerization initiator solution composed of 5 g of the polymerization initiator KPS and 200 ml of ion-exchanged water was added. This system was heated and stirred at 98° C. for 12 hours so as to perform polymerization (the second step polymerization). Thus latex or a dispersion of complex resin particles, which is comprised of high molecular weight resin particles each covered with the medium molecular weight resin, was prepared; the latex was referred to as Latex 1HM.

3. Formation of the Outer Layer (the Third Step of Polymerization)

An initiator solution composed of 6.8 g of the polymerization initiator KPS and 265 ml of ion-exchanged water was added to the above-obtained Latex 1HM. To thus obtained dispersion, a monomer mixture liquid composed of 249 g of styrene, 88.2 g of n-butyl acrylate, 19.4 g of methacrylic acid and 7.45 g of n-octyl-3-mercatopropionate was dropped spending for 1 hour at a temperature of 80° C. After the completion of the dropping, polymerization (the third step of polymerization) was performed for 2 hours while heating and stirring. Then the suspension was cooled by 28 ° C. Thus a latex was obtained, which is a dispersion of resin particles each having the core of the high molecular weight resin, the interlayer of the medium molecular weight resin containing a releasing agent 19, and the outer layer of the low molecular weight resin. The latex was referred to as Latex 1HML.

Preparation of Latex 1L

A polymerization initiator solution composed of 14.8 g of the polymerization initiator, potassium persulfate KPS, dissolved 400 g ion-exchanged water was added and heated by 80° C. The a monomer mixture liquid composed of 600 g of styrene, 190 g of n-butyl acrylate, 30 g of acrylic acid and 20.8 g of n-octyl-3-mercaptopropionate was dropped into the surfactant solution and heated and stirred for 2 hours at 80 ° C. to perform polymerization. Thus obtained dispersion was referred to as Latex 1L.

The resin particle constituting Latex 1L had peaks of molecular weight at 11,000, and the weight average diameter of the complex resin particle was 128 nm.

<Dispersing of Colorant>

In 1,600 ml of ion-exchanged water, 90 g of the anionic Surface Active Agent A was dissolved by stirring, and then 400.0 g of carbon black "REGAL 330R" was gradually added while stirring. Thereafter, the pigment was dispersed by a stirring machine CLEARMIX manufactured by M-Technique Co., Ltd. Thus a dispersion of colorant particles, hereinafter referred to as Colorant Dispersion 1, was prepared. The particle diameter of the colorant particle was 110 nm which was measured by an electrophoresis light scattering photometer ELS 800, manufactured by OTSUKA ELECTRONICS CO., LTD.

<Coagulation, Fusion-adhesion Process>

Into a reaction vessel or a four mouth flask to which a thermo sensor, cooler, nitrogen gas introducing device and stirring device were attached, 420.7 g of Latex 1HML in terms of solid ingredients, 900 g of ion-exchanged water and Colorant Dispersion 1 were charged and stirred. The temperature of the contents of the flask was adjusted to 30° C. Then 5 moles per liter aqueous solution of sodium hydroxide was added so as to make the pH value of 9.0.

Thereafter, a solution composed of 12.1 g of magnesium chloride hexahydrate and 1,000 ml of ion-exchanged water was added to the above-obtained dispersion spending 10 minutes at 30° C. while stirring. After standing for 3 minutes, the system was heated so that the temperature is attained at 90 ° C. spending 60 minutes. The particle size of the associated particle was measured by Coulter Counter TA-II in such the status and a solution composed of 40.2 g of sodium chloride and 1,000 of ion-exchanged water was added at the time at which the number average particle diameter were attained at 5.0 $\mu$m to stop the growing of the particle. The heating and stirring were further continued 2 hours at 98° C. as a ripening treatment for continuing the fusion-adhering of the particles. It was cooled by 30° C. at 8° C./min.

(Shell Forming Procedure)

After the above-described treatment of the coagulation, fusion-adhering and association, 96 g of Latex 1L was added to the obtained particles and heating and stirring were continued for 3 hours so that the Latex 1L was fusion-adhered onto the associated particle of Latex 1HML. Then 40.2 g of sodium chloride was added and the system was cooled by 30° C. in a rate of 8° C., and the pH was adjusted to 2.0 by the addition of hydrochloric acid, and the stirring was stopped.

<Drying Process>

Thus produced salted, coagulated and fusion-adhered particles were filtered and washed by using ion-exchanged water at 45° C. repeatedly. After washing, filter cake was dried at 45° C. and reduced pressure around 10 kPa for 10 hours to remove remaining volatile substance in the toner. The obtained toner was crushed by employing Henschel Mixer and was sieved with 45 mm mesh to obtain Colored Resin Particle 1.

Preparation of Colored Particle 2

Colored resin particles 2 was prepared in the same manner as in Colored Resin Particle 1 except that 0.03 g of t-butyldimethylsilanol was used in place of trimethylsilanol.

Preparation of Colored Particle 3

Colored resin particles 3 was prepared in the same manner as in Colored Resin Particle 1 except that 0.05 g of t-triisopropyl silanol was used in place of trimethyl silanol.

Preparation of Colored Particle 4

Colored resin particles 4 was prepared in the same manner as in Colored Resin Particle 1 except that an amount of trimethyl silanol was modified to 0.06 g, and the drying was performed at 45° C. and reduced pressure around 10 kPa for 8 hours.

Preparation of Colored Particle 5

Colored resin particles 5 was prepared in the same manner as in Colored Resin Particle 1 except that an amount of trimethyl silanol was modified to 0.07 g.

Preparation of Comparative Colored Particle 1

Comparative Colored Particle 1 was prepared in the same manner as in Colored Resin Particle 1 except that the addition of silanol compound was omitted and drying was performed at 45° C. and normal pressure for 10 hours.

Preparation of Comparative Colored Particle 2

Comparative Colored Particle 2 was prepared in the same manner as in Colored Resin Particle 1 except that an amount of trimethyl silanol was modified to 0.10 g Preparation of Comparative Colored Particle 2

Comparative Colored Particle 3 was prepared in the same manner as in Colored Resin Particle 2 except that drying was performed at 45° C. and normal pressure for 10 hours.

(Preparation of Toners and Developers)

Each of the above-prepared Colored Resin Particles 1 through 5 and the Comparative Colored Resin Particles 1 through 3 were mixed with 1.0% by weight of hydrophobic silica having a number average primary particle diameter of 12 nm and a hydrophobilized degree of 68 and hydrophobic titanium oxide having a number average primary particle diameter of 20 nm and a hydrophobilized degree of 63 by a Henschel mixer to prepare Toners for developing static latent image 1 through 5 and Comparative Toners 1 through 3.

(Preparation of Developer)

Each of the toners prepared as above was blended with a silicone resin coated ferrite carrier having a volume average diameter of 60 μm. Subsequently, Developers 1 through 5, as well as Comparative Developers 1 through 3, were prepared in which each of the toner concentrations was 6 percent.

(Quantitative Analysis of Organic Silanol Compounds in Toners)

The organic silanol compounds of each of the toners, except for Comparative Toner 1, were quantitatively analyzed employing the aforesaid head space gas chromatographic analytical method. It was found that Toner 1 contained trimethylsilanol in an amount of 1.2 ppm as an organic silanol compound and its amount. Table 1 shows the measurement values of organic silanol compounds of each of the other toners.

Further, Table 1 also shows the details of each of the toners prepared as above.

TABLE 1

| | Organic Silanol Compound | | Drying | | Average particle | Remaining organic silanol | *Shape coefficient | |
|---|---|---|---|---|---|---|---|---|
| Toner No. | Compound | Amount (ppm) | Pressure | Time (Hours) | diameter (μm) | compound (ppm) | of 1.2 to 1.6 (%) | Remarks |
| 1 | Trimethyl silanol | 10 | Reduced Pressure | 10 | 5.5 | 1.2 | 75.1 | Inv. |
| 2 | t-Butyldimethyl silanol | 30 | Reduced Pressure | 10 | 5.4 | 5.3 | 73.2 | Inv. |
| 3 | Triisopropyl silanol | 50 | Reduced Pressure | 10 | 5.5 | 14.5 | 76.3 | Inv. |
| 4 | Trimethyl silanol | 60 | Reduced Pressure | 8 | 5.4 | 16.5 | 72.5 | Inv. |
| 5 | Trimethyl silanol | 70 | Reduced Pressure | 10 | 5.5 | 19.8 | 68.9 | Inv. |
| Comp. 1 | — | — | Normal Pressure | 10 | 5.5 | 0 | 60.2 | Comp. |
| Comp. 2 | Trimethyl silanol | 100 | Reduced Pressure | 10 | 5.5 | 20.5 | 63.1 | Comp. |
| Comp. 3 | t-Butyldimethyl silanol | 30 | Reduced Pressure | 10 | 5.5 | 28.0 | 62.5 | Comp. |

*Content of toner particles having shape coefficient of 1.2 to 1.6

<<Evaluation of Each Characteristic>>

(Evaluation of Distribution of Releasing Agent)

After molding each of the toner powders employing molding resins, a 0.1–0.2 μm thick ultra-thin slice was prepared employing an ultra-microtome. The resulting slice was observed and photographed at a magnification factor of 20,000, employing a transmission type electron microscope. Subsequently the distribution of the releasing agent in the toner particle was evaluated based on the criteria described below.

A: The distribution of the particle diameter of the dispersed releasing agent particles was narrow and the releasing agent particles were uniformly distributed in the toner B: One or two relatively large releasing agent particles were observed in the visual field, but the distribution of the releasing agent particles in the toner was uniform C: At least three large releasing agent particles were observed in the visual field, and the distribution of releasing agent particles in the toner was not uniform (Evaluation of Off-Setting Resistance)

The fixing apparatus of a digital copier, Konica Sitios 7065, produced by Konica Corp., was modified, and image off-setting and toner staining of the heating roller were evaluated.

The fixing apparatus was modified in such a manner that the cleaning mechanism and the like which came into contact with the heating roller were removed so that nothing could come into contact with the heating roller. The ambience during copying was set at normal temperature and normal pressure (25° C. and 55 percent relative humidity). The surface temperature of the arranged heating roller for fixing was varied at increments of 10° C. in a range of 150 to 180 ° C. At each surface temperature, A4 size plain paper sheets, having 5 mm wide solid black belt-shaped images at right angles to the conveying direction were longitudinally conveyed and subsequently fixed. Thereafter, A4 size plain paper sheets, having 5 mm wide solid black belt-shaped images and 20 mm wide halftone images at right angles to the conveying direction were laterally conveyed. Each of the obtained samples was visually inspected in regard to image stain (image off-setting) due to fixing off-setting and toner stains on the heating roller surface. Off-setting resistance was then evaluated based on the criteria described below.

A: Neither image off-setting nor toner stains on the heating roller surface was noticed
B: Slight image off-setting and toner stains on the heating roller surface were noticed
C: Image off-setting was not noticed but toner stains on the heating roller surface were noticed
D: Both image off-setting and toner stain on the heating roller surface were noticed
E: Image off-setting was clearly noticed and the heating roller surface was markedly stained In the aforesaid evaluation ranking, A and B were judged to be in the range of commercial viability.

(Evaluation of Storage Stability of Toners)

Placed in a sample tube was 2 g of each of the toners prepared as above. After shaking the tube 500 times employing a tapping denser, the resulting tube was allowed to stand for two hours under an ambience of 55° C. and 35 percent relative humidity. Subsequently, the resulting toner was placed in a 48 mesh sieve and was sieved under definite vibration conditions. The ratio (in percent by weight) of the residual toner remaining on the sieve was determined. The resulting ratio was designated as a toner coagulation ratio and the storage stability of the toner was evaluated based on the criteria described below.

A: The toner coagulation ratio was less than 15 percent by weight (the storage stability of the toner was excellent)
B: The toner coagulation ratio was between 15 and 45 percent by weight (the storage stability of the toner was good)
C: The toner coagulation ratio was between 46 and 60 percent by weight (the storage stability of the toner was judged to be in the commercially viable range)
D: The toner coagulation ratio exceeded 60 percent by weight (the storage stability of the toner was considered to be not commercially viable)

(Evaluation of Background Stain Resistance)

Performed as one of the stability test methods of charging performance was a background stain formation test.

A commercially available digital copier, Konica Sitios 7075, was employed as the apparatus for evaluation. Under an ambience of 33° C. and 80 percent relative humidity, employing an original image document, having four equal quarters of a text image having a pixel ratio of 7 percent, a portrait, a solid white image, and a solid black image, 50,000 A4 sheets were subjected to continuous output under a one sheet intermittent mode.

Density at 20 positions of non-printed white paper was measured employing a reflection densitometer "RD-918", produced by Macbeth Corp., and the average value was designated as the white paper density.

Subsequently, density at 20 positions of the white portion of the 50,000th sheet obtained by continuous printing was also measured, and the average value was designated as the background stain density. Background stain resistance was evaluated based on the criteria described below.

A: The background stain density was less than 0.003
B: The background stain density was between 0.003 and 0.006
C: The background stain density was between 0.006 and 0.010
D: The background stain density was at least 0.010

(Evaluation of Unpleasant Odors Resistance)

In a tightly sealed room having a floor of 5×5 m and a height of 2 m, an original image document having four equal quarters of a text image, having a pixel ratio of 7 percent, a portrait picture, a solid white image, and a solid black image, was continuously printed onto 1,000 sheets. Thereafter, 20 monitors detected the presence or absence of unpleasant odors, and unpleasant odor resistance was evaluated based on the criteria described below.

A: None of the monitors detected unpleasant odors
B: One or two monitors detected unpleasant odors
C: At least three monitors detected unpleasant odors Table 2 shows the obtained results.

TABLE 2

| Toner | Distribution of Releasing | Fixing Temperature: ° C. | | | | Toner Storage | Back-ground Stain | Odors | |
|---|---|---|---|---|---|---|---|---|---|
| No. | Agent | 150 | 160 | 170 | 180 | Stability | Resistance | Resistance | Remarks |
| 1 | B | B | A | A | A | A | A | A | Inv. |
| 2 | A | A | A | A | A | A | A | A | Inv. |
| 3 | A | A | A | A | A | A | A | A | Inv. |
| 4 | A | A | A | A | A | B | A | B | Inv. |
| 5 | A | A | A | A | A | B | A | B | Inv. |
| Comp. 1 | D | D | C | B | A | A | D | A | Comp. |
| Comp. 2 | A | A | A | A | A | C | A | D | Comp. |
| Comp. 3 | A | A | A | A | A | D | A | D | Comp. |

As can clearly be seen from Table 2, toners comprising organic silanol compounds according to the present invention in an amount of 1 to 20 ppm exhibited excellent distribution of the releasing agents in the aforesaid toner, excellent storage stability, excellent off-setting resistance at low temperature, excellent background stain resistance, and excellent unpleasant odors resistance, compared to Comparative Examples.

In accordance with the present invention, it is possible to provide an electrostatic image developing toner which exhibits a wide fixing temperature range, excellent off-setting resistance as well as excellent fixability, in addition, exhibits excellent storage stability and excellent background stain resistance, and minimizes unpleasant odors, and an image forming method using the same.

What is claimed is:

1. An electrostatic image developing toner comprising a toner particle comprising a resin and a colorant, wherein the toner particle further comprises a compound represented by formula (1) in an amount of 1 to 20 ppm by weight of based on the total amount of the toner which is measured based on a head space method:

$$R_m Si(OH)_n \quad (1)$$

wherein R represents a hydrocarbon group containing an alkyl group, a vinyl group, a glycidyloxy group, or a methacrylic acid, m and n each represents an integer of 1 to 3, and when m is 2 or 3, R may be the same or different.

2. The electrostatic image developing toner of claim 1, wherein an amount of the compound represented by formula (1) is from 5 to 15 ppm.

3. The electrostatic image developing toner of claim 1, wherein the compound represented by formula (1) is trimethylsilanol, triethylsilanol, t-butyldimethylmethylsilanol, triisopropylsilanol, tri-t-butylsilanol, dimethyldihydroxy silane, diisopropyldihydroxy silane, or di-t-butyldihydroxy silane.

4. The electrostatic image developing toner of claim 3, wherein the compound represented by formula (1) is trimethylsilanol, t-butylmethylsilanol, or triisopropylsilanol.

5. The electrostatic image developing toner of claim 1, wherein the toner particle has a shape coefficient of from 1.2 to 1.6 of not less than 65% in number.

* * * * *